US005735330A

United States Patent [19]

Buchmann et al.

[11] Patent Number: 5,735,330

[45] Date of Patent: Apr. 7, 1998

[54] FORMATION IN A TWO FABRIC PAPER MACHINE

[75] Inventors: Werner Buchmann, Baie d'Urfe, Canada; Michael McMahon, Peachtree, Ga.; Richard Pitt, Almonte, Canada

[73] Assignee: JWI Ltd., Kanata, Canada

[21] Appl. No.: 661,871

[22] Filed: Jun. 11, 1996

Related U.S. Application Data

[63] Continuation-in-part of Ser. No. 226,321, Apr. 12, 1994, abandoned.

[51] Int. Cl.[6] ..... D21F 1/00

[52] U.S. Cl. ..... 162/301; 162/300; 162/352

[58] Field of Search ..... 162/300, 301, 162/352

[56] References Cited

U.S. PATENT DOCUMENTS

| | | | |
|---|---|---|---|
| 2,928,465 | 3/1960 | Wrist | 162/352 |
| 3,337,394 | 8/1967 | White et al. | 162/352 |
| 3,573,159 | 3/1971 | Sepall | 162/374 |
| 3,598,694 | 8/1971 | Wiebe | 162/352 |
| 3,874,998 | 4/1975 | Johnson | 162/308 |
| 3,922,190 | 11/1975 | Cowan | 162/352 |
| 4,140,573 | 2/1979 | Johnson | 162/209 |
| 4,420,370 | 12/1983 | Saad | 162/209 |
| 4,687,549 | 8/1987 | Kallmes | 162/352 |
| 4,789,433 | 12/1988 | Fuchs | 162/352 |
| 4,838,996 | 6/1989 | Kallmes | 162/352 |
| 4,999,087 | 3/1991 | Ebihara | 162/301 |
| 5,061,347 | 10/1991 | Bubik et al. | 162/352 |
| 5,167,770 | 12/1992 | Bubik et al. | 162/301 |
| 5,203,967 | 4/1993 | Bando et al. | 162/301 |
| 5,248,392 | 9/1993 | Bando | 162/301 |

FOREIGN PATENT DOCUMENTS

| | | | |
|---|---|---|---|
| 3138133 | 3/1983 | Germany | 162/300 |

OTHER PUBLICATIONS

Hettle et al; "Twin Wire Forming at Powell River – A Preliminary Review" Technical Paper 23, 2nd Newsprint Conference, 1971.

*Primary Examiner*—Karen M. Hastings
*Attorney, Agent, or Firm*—Robert A. Wilkes

[57] ABSTRACT

A forming section for a two-fabric paper machine using at least one formation blade having a shallow cavity in its top surface. The cavity is placed and dimensioned to withdraw fluid continuously from the stock, and to propel it back through the fabric and the incipient paper web into the stock so as to cause a controlled level of localized turbulence which serves to improve formation without causing excessive drainage or fines loss. The formation blade shape, in conjunction with the forming fabric tension, is configured to provide a hydraulic seal between the fabric and the stock, so that all of the withdrawn fluid is returned to the stock.

16 Claims, 5 Drawing Sheets

FORMATION IN A TWO FABRIC PAPER MACHINE

This application is a continuation-in-part of application Ser. No. 08/226,321, filed Apr. 12, 1994 now abandoned.

BACKGROUND OF THE INVENTION (a) Field of the Invention

The present invention relates to a forming section for use in a two fabric paper making machine, and is specifically directed at improving the formation of the paper made on the machine, by introducing fluid motion into the layer of stock constrained between the two forming fabrics in a manner that does not increase local drainage or reduce retention.

(b) Description of the Prior Art

In order to produce a good quality paper sheet it is necessary to randomize the distribution of the constituent cellulosic fibers, fines and fillers in the papermaking stock as the sheet is formed, so that the commonly measured finished sheet parameters are all optimized to the greatest extent possible. Optimization of these paper properties is governed by the geometry of the forming section and the fluid stock mixture and is typically accomplished by randomizing the distribution of the fluid stock constituents in each of the thickness or "Z" direction, machine direction, and cross-machine direction so that the stock mixture is as homogeneous as possible.

The forming sections of two-fabric paper making machines are of two general types: hybrid formers and gap formers. There are two generic types of gap formers: roll-gap formers, wherein drainage pressure is created by the convergence of both fabrics over a rotating roll, and blade-gap formers, wherein drainage pressure is created by the passage of the fabrics over stationary blades, ribs, strips or edges at some angle of wrap so as to induce pressure pulses in the stock constrained between the fabrics. The fabric contacting surfaces of these stationary surfaces are generally flat or convex.

Roll-gap formers offer generally poorer formation than blade-gap formers, but provide better retention of fine particles because the squeezing action of the fabric wrapping about the roll does not subject the stock to any pressure pulses. Roll-gap formers also provide better control over the ratio of the paper web properties in the machine and cross machine directions, generally referred to as the MD/CD ratio. However, blade gap formers generally provide better sheet formation, but have poorer retention of fine particles than roll-gap formers, because of the pressure pulses induced in the stock by the stationary blades as the fabrics wrap over the fabric support surfaces in the forming section. The magnitude and frequency of these pressure pulses are limited by the geometry of the forming section. Although these pressure pulses induce shearing effects in the stock which break up flocs, thereby improving formation, they may also increase the MD/CD ratio in the paper web.

An effective means of introducing agitation into the stock in the forming section of a single fabric paper machine is to utilize the surface profile of foil blades which are intended to remove the fluid from beneath the forming fabric. Numerous proposals by Wrist (U.S. Pat. No. 2,928,465), Sepall (U.S. Pat. No. 3,573,159), Wiebe (U.S. Pat. No. 3,598,694), Johnson (U.S. Pat. No. 3,874,998), Cowan (U.S. Pat. No. 3,922,190) and Johnson (U.S. Pat. No. 4,140,573), amongst others, implemented the foiling principle to a greater or lesser degree for this purpose. In essence, these inventions utilize the foil blade profile to remove fluid from the stock, and then either force it back through the forming fabric, as in Johnson '998, or cause the fabric to follow an undulating path as it proceeds through the forming section, as in Johnson '573. Others, including Kallmes (U.S. Pat. No. 4,687,549), Fuchs (U.S. Pat. No. 4,789,433) and Kallimes (U.S. Pat. No. 4,838,996), teach that blade surface profile may be used to either induce microturbulence or drain the stock. All of these disclosures are specifically directed at improving the quality of paper made in single fabric paper machines. None of these teachings can be practiced directly without modification, in some cases substantial, on a two fabric paper machine where the stock is between two fabrics that are held together as they wrap a forming shoe or series of forming blades. Although it has been suggested by Sepall (U.S. Pat. No. 3,573,159) and Saad (U.S. Pat. No. 4,420,370) that technology developed for an open surface single fabric machine can be used in a two fabric machine, so far as applicants are aware none of these concepts has ever been applied successfully to a two fabric machine. Further, neither Sepall nor Saad even suggest how this might be achieved.

In U.S. Pat. No. 3,874,998, Johnson discloses an improvement to the Sepall device whereby multiple, replaceable blades are utilized to agitate the stock on a single fabric machine. The foiling action developed at the upstream declining surface of the blade channel withdraws fluid from the stock, which is then forced back into the underside of the fabric by the downstream inclining surface of the channel. The upward force of this liquid causes a disruption in the upper surface of the stock, which may benefit formation if small, but which may worsen formation if excessive. Because there is no means of hydraulically sealing the fabric over the downstream fabric contact surface of the blade, the momentum of the fluid forced upwardly by the downstream divergent wall of the channel may lift the fabric from this portion of the blade. White water will then escape, thus increasing drainage, reducing retention and impairing the effective benefit of the upward fluid movement. Johnson only discloses the use of this blade in the forming section of a single fabric machine, and a two fabric paper machine is not mentioned. The open surface agitation Johnson describes is impossible in a two fabric machine, as there is no exposed stock surface.

The main mechanism for improving paper formation in the forming sections of two-fabric paper machines has been to utilize the pressure pulses generated within the stock constrained between the fabrics as the fabrics bend over the edges of stationary fabric contacting surfaces. These pressure pulses introduce machine direction shearing forces into the stock layer which serve to break up flocs and randomize the fiber dispersion. Reference is made in this connection to Ebihara, U.S. Pat. No. 4,999,087 and to Bando, U.S. Pat. No. 5,248,392.

In U.S. Pat. No. 4,999,087, Ebihara describes a two-fabric forming section in which dewatering devices are arranged on opposite sides of the two fabrics so as to press inwardly towards the stock, thereby causing the fabrics to follow a zig-zag path.

In U.S. Pat. No. 5,248,392, Bando discloses a forming apparatus for use in a two-fabric forming section which consists of two devices, located alternately on opposite sides of the fabrics, each comprising several shoe blades with vacuum assisted drainage spaces between them. The lands of the shoe blades have a flat leading surface coinciding with the line of travel of one of the two fabrics, a mid section comprising a wedge-shaped trough whose depth decreases in the downstream direction, and a back surface which may be flat, or may be a leading flat portion followed by a trailing portion which slopes away from the fabrics in the downstream direction, which provides a foiling action. Since either the back surface, or the leading portion of the back surface, is at a small angle relative to the plane of the fabric, the fabric bends at the leading edge of the back surface and generates a pressure pulse which begins over the wedge-shaped trough and extends in the downstream direction. Each trough begins abruptly at 90°, as in Ebihara, and then inclines angularly upwards until it meets the downstream back surface of the blade.

It is clear from the prior art teachings of Wrist and Johnson that the abrupt 90° depression angle of the divergent upstream walls of the troughs as taught by Ebihara and Bando will not spontaneously foil water from the stock sandwiched between the two forming fabrics. According to Bando, water entry into the trough is thus dependent on a pressure pulse generated as the two fabrics bend over the shoe blade.

The only known way to increase the beneficial shearing action introduced by these blades has been to increase either or both the fabric tensions, or the wrap angles of the fabrics about the blades. However, both of these actions also increase the machine direction fiber orientation, as well as drainage of liquid and fines from the stock. The increased magnitude of the pressure pulses reduces retention and increases the MD/CD ratio in the finished paper.

It would be desirable if paper formation in a two fabric machine could be more effectively controlled without the penalty of reduced retention. Thus, this invention seeks to provide a means whereby a fluid flow of sufficient force to improve formation can be locally generated within the stock. This fluid flow is independent of any pressure pulses induced by any bending of the fabrics, and does not increase local drainage and reduce retention. Applicants have now discovered that it is possible to introduce a relatively smooth, and yet powerful, fluid motion within the stock by locating in contact with at least one of the fabrics in the forming section of a two-fabric paper machine at least one formation blade having a fabric contacting surface including a cavity. The shape of the cavity provides a foiling action which results in fluid being withdrawn from the stock layer into the cavity, whilst the overall size of the cavity determines the amount of fluid withdrawn. This fluid is then forcibly propelled back through the fabric in contact with the blade, through the incipient paper web and into the stock by its momentum. The fabrics wrap about such a formation blade with only a small angle that is sufficient, in combination with the fabric tension, to maintain a hydraulic seal between the blade surface and the fabric. The localised fluid motion generated in the stock by the fluid flow is sufficient to improve formation.

Thus this invention does not rely on a shearing action developed within the stock layer by pressure pulses, for example as is taught by both Ebihara and Bando '392. The profile of the fabric contact surface of a formation blade according to this invention is chosen so as to provide precisely controlled fluid movement from the stock between the two fabrics into the cavity, and from the cavity back into the stock. This level of smooth fluid flow induced within the stock overshadows any benefits provided by the relatively abrupt and sudden effects of the pressure pulses advocated in the prior art for two fabric paper machines.

We have also discovered that the fabric contact surfaces on each side of the cavity, in combination with the effects of the tension on the two fabrics and the water in the stock, need only provide a hydraulic seal between the formation blade surface and the first fabric so as to contain the fluid motion. The fabric contact surfaces of these novel formation blades may be flat or convex, and of equal or unequal length. Further, the magnitude of the fluid motion introduced into the stock may now be controlled by changes in blade width, surface profile and spacing, rather than having to rely, as in the prior art, on fabric wrap angles that are predetermined by machine geometry and tensions. It is relatively easy to remove and replace a formation blade and thereby change the formation conditions; it is not relatively easy to alter the path of the two forming fabrics to provide different wrap angles. It is thus possible to improve retention and reduce the MD/CD ratio, so as to provide a better quality paper sheet.

For the purposes of this invention, the following definitions are important:

a) "machine direction", or MD, means a direction substantially parallel to the direction of motion of the forming fabrics, "cross-machine direction", or CD, means a direction substantially parallel to the plane of the forming fabrics, and substantially perpendicular to the machine direction, and "Z direction" means a direction substantially perpendicular to both the machine and cross machine directions;

b) "upstream" and "leading" each refer to a position in the machine direction that is closer to the headbox, and "downstream" and "trailing" each refer to a position in the machine direction that is further from the headbox;

c) "paper side" refers to that surface of a forming fabric which in use is in contact with the paper web, and "machine side" refers to the other surface of the fabric;

d) "wrap" and "angle of wrap" refer to the bending through a measurable angle of the plane of the fabrics about a leading or trailing edge of a support surface, or about the surface of a convex support surface, an angle of wrap being measured with the forming fabric static but under machine tension; and e) "hydraulic seal" means the active fluid seal existing while the forming section is operating between a forming fabric, a support surface, and the water in the stock.

SUMMARY OF THE INVENTION

The present invention provides a forming section, for use in a two-fabric paper making machine having a machine direction and a cross machine direction, including in combination:

(i) a first and a second endless moving forming fabric loop, both loops moving in a joint run at a known speed and under a known tension through the forming section, and between which fabrics a layer of stock of known thickness is conveyed;

(ii) at least one formation blade extending in the cross machine direction in contact with the first fabric such that under the machine direction tension both fabrics with stock therebetween wrap about the at least one blade so that each fabric has a total angle of wrap that is equal to or greater than 0.5° while the first fabric is in hydraulically sealing contact with the formation blade;

(iii) both first and second fabrics wrapping about the downstream edge of the at least one blade with an angle of wrap that is equal to or greater than 0.5°;

(iv) the at least one formation blade having a top face, a bottom, a leading edge and a trailing edge;

(v) the top face of the at least one blade having upstream and downstream fabric contact surfaces in contact with the first fabric with a cavity intervening therebetween; and (vi) the intervening cavity including upstream and downstream walls each diverging from the upstream and downstream fabric contacting surfaces, and having both a Z direction depth measured from the machine side of the first fabric to the lowest point in the cavity, and a machine direction width, wherein a) the upstream cavity wall diverges from the upstream fabric contact surface in a down stream direction at an angle which is from about 0.5° to about 8°, b) the downstream cavity wall diverges from the downstream fabric contact surface in an upstream direction at an angle which is from about 0.5° to about 8°, and c) the cavity depth and width are each sized in proportion to the thickness of the stock layer above the blade upstream fabric contact surface so as to withdraw fluid from the stock between the forming fabrics by a foiling action, and to return the withdrawn fluid back into the stock as a smooth flow, the amount of fluid flow being effective to improve formation, but ineffective to break the hydraulic seal between the fabric and the formation blade.

Preferably, in a forming section according to the invention, the at least one formation blade includes a cavity in which:

d) the cavity depth is greater than about 5% and less than about 35% of the thickness of the stock layer above the blade upstream fabric contact surface, e) the cavity width ranges from a minimum of about 2.5 times to a maximum of about 25 times the thickness of the stock layer above the blade upstream fabric contact surface, and f) the cavity width and depth are such that when the forming section is operating the cavity is filled with fluid.

It is preferred for this invention to use the T-shaped blade mounting arrangement disclosed by White et al. in U.S. Pat. No. 3,337,394. Rocking of the blades on the mounting rail during normal machine operation may thus be restricted to no more than ±0.25°, and each blade may be replaced quickly and easily.

The forming section of the present invention is structured and arranged so that a first one of the two fabrics is in hydraulically sealing contact with both the upstream and downstream fabric contact surfaces of the blade. By careful choice of the blade profile a desired smooth flow of liquid out of, and back into, the stock between the forming fabrics is induced which will improve formation, but without breaking up the existing incipient paper web. Blade surface profile, blade position, and fabric tensions thus now cooperate in a novel fashion so as to improve web formation in a manner which does not detrimentally affect the retention of fine particles in the stock, and whose effectiveness is not limited by the structure and geometry of the paper machine forming section.

The effect produced in the stock during operation of the forming section of this invention is thus fundamentally different from that obtained using the agitator blade disclosed by Johnson, in U.S. Pat. No. 3,874,998 for a single wire machine. In the present invention, smooth fluid flow is introduced into the stock by fluid motion out of, and back into, the stock, creating a stirring effect, without any internally generated pressure changes. Due to the combined effects of fabric tension and the small wrap angle, the thickness of the stock layer between the two fabrics changes in response first to the foiling action, and second to the return flow. Thus there are no relatively violent events such as the kick-up and open surface agitation associated with the use of the blade disclosed by Johnson in a single fabric open surface machine. Although the formation blades of the present invention share some gross physical resemblances to those disclosed by Johnson, their manner of operation is strikingly different, and the sizes of the cavities used are also remarkably different.

The effect produced in the stock during operation of the forming section of this invention is also fundamentally different from that obtained using the positive pulse shoe blades disclosed by Bando et al, in U.S. Pat. No. 5,248,392 for a twin wire machine. Bando et al generate a shearing pressure pulse within the stock by bending the two forming fabrics with the stock therebetween through a small angle. Any stock liquid exuded through the forming fabrics as a consequence of this pressure pulse is not returned, but is drained away as white water and thus adversely affects retention particularly of fines.

We have found it to be critical that the upstream and downstream fabric contacting surfaces of the formation blade have sufficient machine direction length to ensure a hydraulic seal during forming section operation. We have found that for most paper making machines, the minimum machine direction length of each of the upstream and downstream fabric contact surfaces of these formation blades desirably is at least 6.4 mm, and preferably is about 9.5 mm. The maximum machine direction length of each of the upstream and downstream fabric contact surfaces desirably is at most about 25.4 mm, and is preferably no more than about 38.1 mm. However it is to be understood that other machine direction lengths might be desirable depending on the conditions of operation of the paper making machine, so as to provide the necessary hydraulic seal.

The upstream and down stream contact faces can be of the same or different machine direction length. It appears to be desirable that the downstream surface should be longer than the upstream one. The upstream and downstream contact faces can be substantially coplanar, or one or both of them can be curved, with a slight convex curve approximating the path of the first fabric so that it approaches and leaves the fabric contacting surfaces tangentially. In a typical single sided curved forming shoe the radius of this curvature may be in the order of from about 250 cm to about 510 cm. In a typical two-sided shoe, in which a plurality of formation blades may be alternately located on opposing sides so that the two fabrics follow a somewhat zig-zag path, the radius of curvature is often smaller, typically in the range of from about 25 cm to about 50 cm.

It is also necessary that the cavity in the formation blade be designed to ensure that the required foiling action withdraws a continuum of fluid from the stock, and which is thereafter returned as a continuum to the stock between the fabrics. The volume of the cavity, and thus its depth and width, and the angular orientation of its upstream and down stream walls, must be selected in conjunction with the thickness of the stock. We have found that, as a general rule, the depth of the cavity as measured from the machine side of the forming fabric to its bottom should be from about 5% to about 35% of the thickness of the stock carried between the two forming fabrics as they are in hydraulically sealing engagement with the upstream fabric contact surface of the formation blade. If the cavity depth is less than this minimum, it is unlikely that a sufficient volume of fluid will be withdrawn to have a beneficial effect, and if the cavity depth exceeds this maximum, then the hydraulic seal may be broken by the force of the uprushing fluid, causing leakage and reduced retention, although in some applications values as high as 75% have been found useable. In practise it has been found that cavity depths ranging from a minimum of about 0.38 mm to a maximum of about 2.5 mm are often sufficient, but higher values up to at: least about 10 mm may be required for some thick stock applications, such as in making liner board. These cavity dimensions are significantly larger than those for a Johnson blade to be used in an open surface single fabric forming section making a similar grade of paper product.

The walls of the cavity can be either planar or curved, and both decline from the respective upstream and downstream fabric contacting surfaces at an angle which is from about 0.5° to about 8°. More preferably, this angle is from about 0.5° to about 5°. Most preferably, this angle is from about 1° to about 4°. For curved walls somewhat in the form of a shallow ellipse the tangent angle to the curve taken at the ends of the upstream and downstream walls is within the same ranges.

In a first preferred embodiment, the forming section of the present invention is comprised of a plurality of stationary fabric contacting surfaces, at least one of which is a formation blade, in which only the first fabric travels in contact with all of the fabric contacting surfaces, and the path described by the two fabrics as they proceed over the fabric contacting surfaces is that of a segmented curve.

In a second preferred embodiment, the forming section of the present invention is comprised of a plurality of stationary fabric contacting surfaces at least one of which is a formation blade, in which the stationary fabric contact surfaces are located in alternating positions on opposing sides of the two fabrics, so that each of the first and second fabrics alternately contacts the stationary fabric contact surfaces as they travel along a substantially zig-zag path.

It is not necessary that all of the blades utilized in the forming section be formation blades; beneficial adjustments to the sheet properties may be obtained by interspersing these formation blades with ordinary support blades or surfaces which do not contain a cavity. There does not appear to be any rigorous means of determining how many of the blades in the forming section need be formation blades. The number and position of these blades will be determined by the papermaker in response to papermaking requirements, and may be readily changed during operation.

BRIEF DESCRIPTION OF THE DRAWINGS

The invention will now be described with reference to the drawings in which:

As shown in the Figures, all angles have been exaggerated for clarity, as also have the dimensions of all of the cavities shown. In FIGS. 1, 4 and 5 the direction of movement is shown by the arrow X.

DETAILED DESCRIPTION OF THE DRAWINGS

Figure 1:
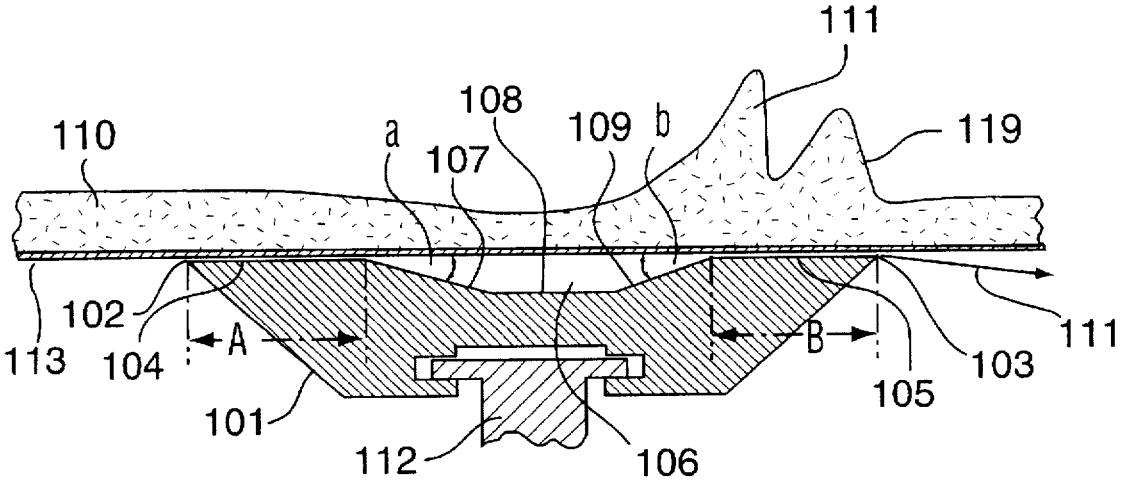
FIG. 1 (PRIOR ART)
FIG. 1 is a side elevation of a portion of a single fabric, open surface paper machine forming section equipped with an agitator blade.
Figure 2:
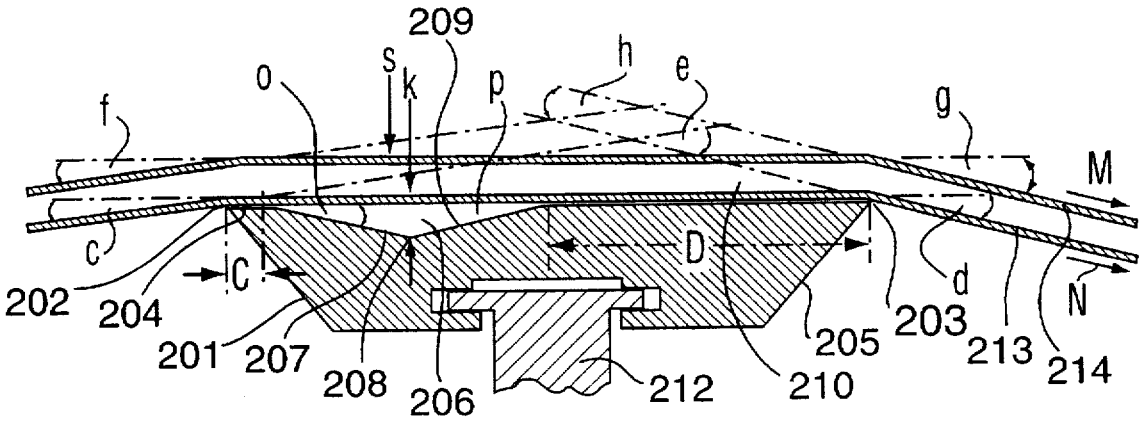
FIG. 2 is a side elevation of a portion of the forming section of a two-fabric paper machine.

FIG. 1 shows an agitator blade in accordance with FIG. 2 in Johnson, U.S. Pat. No. 3,874,998. The blade 101 has upstream and downstream sides providing a leading edge 102, a trailing edge 103, an upstream flat contact surface 104 having a width A, a downstream flat contact surface 105 having a width B which is coplanar with the surface 104, and a channel 106. The channel 106 comprises three discrete flat surfaces: an upstream wall 107, a bottom wall 108, and a downstream wall 109. The wall 107 diverges downstream from surface 104 at an angle a which is from 1° to 8°. Wall 109 diverges upstream from the surface 105 at an angle b which may be from 1° to 70°. As shown in this Figure, the stock activity has been exaggerated for clarity; the blade is illustrated as if in normal operation on a single fabric open surface forming section.

Due to the angle of upstream wall 107, the stock 110 is subjected to a foiling action which withdraws fluid from the stock through the bottom of the fabric 113. This fluid proceeds across the channel bottom wall 108, towards the downstream wall 109 of the channel, and is then positively forced back through the fabric 113 into the stock layer 110 above. The free surface of the stock is disturbed by two actions as the fabric proceeds over the Johnson agitator blade. First, a small deflection of the fabric 113 into the channel 106 causes kick-up 111. Second, the uprushing fluid from the channel 106 causes the surface disturbance 119. It is the generation of these free surface disturbances 111 and 119, and their subsequent oscillatory decay, that provide the needed Z direction agitation of the open surface of the stock, serving to assist in randomising the distribution of the stock constituents in order to get better formation in the incipient paper web.

A problem associated with this blade design when used in an open surface forming section is that if the positive pressure developed by the uprushing fluid exceeds the weight of the stock 110 on the forming fabric 113 above the blade 101, the fabric 113 can be lifted off the surface 105, and white water including fines and fibers as at 114 is then discharged between the fabric and the blade trailing edge 103. At high machine speeds and low stock weights, it is certain that fluid stock will leak from the trailing edge 103 of the blade 101; at lower machine speeds and heavier stock weights, the blade edge 103 may be sealed by the weight of the stock. The effectiveness of this blade in an open surface forming section is thus limited by these conditions.

In FIG. 2 there is shown a portion of a forming section of a two-fabric paper machine; FIG. 2 shows features both of this invention, and of the prior art. As shown, the paper machine is in normal operation with the two fabrics moving over a formation blade 201, the first fabric 213 contacting the blade surface and the second fabric 214 travelling at the same speed as the first and confining therebetween a layer of stock having thickness S over the upstream contact surface of the blade (see also the stock thickness F in FIG. 5).

The cross machine direction blade 201 has top, bottom and upstream and downstream sides providing a leading edge 202, a trailing edge 203, an upstream flat fabric contact surface 204, a downstream flat fabric contact surface 205, both surfaces 204 and 205 being substantially coplanar, and a cavity 206 between the surfaces 204 and 205. The cavity 206 comprises two discrete flat surfaces, forming an upstream wall 207 and a downstream wall 209 which meet at 208, forming the bottom of the cavity 206 at which point the cavity depth k is determined. The wall 207 diverges downstream from surface 204 at an angle o which is from about 0.5° to 8°. Wall 209 diverges upstream from surface 205 at an angle p which is also from about 0.5° to 8°. In prior art blades, the cavity 206 is either absent, or of a quite different shape.

Figure 4:
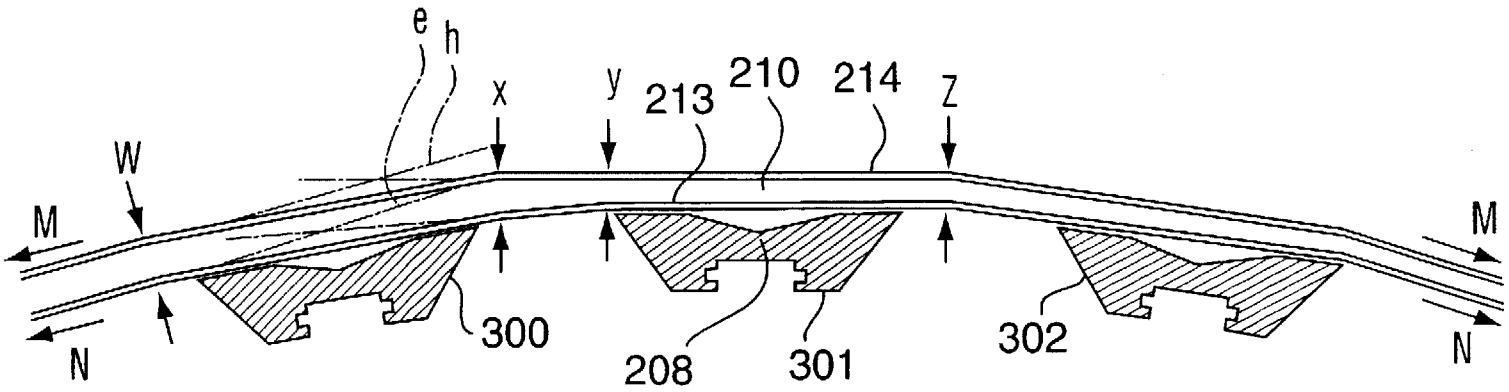
FIG. 4 is a side elevation of a portion of the forming section of a two fabric paper machine in which several formation blades are located on one side of the forming fabrics.

The angles of wrap c, d, e and f of the fabrics 213 and 214, which are under tension as shown by N and M, about the leading edge 202 and the trailing edge 203 as shown are in accordance with prior art practises; these angles of wrap are used to generate pressure pulses in the stock 210. For the purposes of this invention, the angles of wrap at the leading edge 202, as shown in FIG. 4 for formation blade 301, will generally be close to zero: that is, fabric 213 is more or less tangential to surface 204. For the purposes of this invention in order to maintain a hydraulic seal over the surface 205 small angles of wrap d and g have been found to be necessary. The total angles of wrap e and h should both be at least 0.5°, the angle being measured when the machine is at rest, and the fabrics under operating tension. Whilst there is no theoretical upper limit to these angles, experience shows that since it is desirable to avoid the generation of the pressure pulses described by Bando et al both the trailing edge angles of wrap, and the total angles of wrap, should be held as low as possible concomitant with maintaining a hydraulic seal over the surface 207.

It is contemplated that the profile of the blade cavity may have a somewhat elliptical shape, rather than being made up of discrete surfaces 207 and 209 as shown in FIG. 4. In a curved profile cavity, the curve has a tangent angle at the upstream side of the cavity that is from about 0.5° to 8° and a tangent angle at the downstream side of from about 0.5° to 8° (see FIG. 9). In both cases, the tangent is taken at the point where the curve meets the blade top surface.

As the fabrics 213 and 214 move over the contact surfaces 204 and 205, they are positively held down onto this surface by a combination of the angles of wrap f and g, the fabric tensions M and N, and by the negative fluid pressure in the cavity 206 due to the foiling action. The machine side of the fabric 204 is therefore always in a hydraulically sealed relationship with the surfaces 204 and 205. The strength of this seal may be enhanced by increasing the either or both pairs of angles of wrap, by changing the cavity profile, or by increasing the machine direction lengths C and D of the surfaces 204 and 205. FIG. 2 shows a preferred formation blade cross sectional profile in which these various factors are balanced, to give a blade in which the upstream contacting surface 204 is narrower that the down stream contacting surface 205, as shown by the lengths C and D. It is necessary that the hydraulic seal over the surface 205 be effective to contain the Z direction motion of the fluid back into the stock between the two fabrics 213 and 214.

It is also necessary that the cavity 206 is so sized, especially as regards its maximum depth k, to ensure that it is filled with fluid as a result of the foiling action. If, for example, the cavity is too deep relative to the thickness S of the stock, then the foiling action will be largely lost. Fluid flow from the stock into the cavity will then be discontinuous resulting in an uneven and uncontrolled flow of liquid from the cavity back into the stock which will not result in the desired smooth liquid flow, and will adversely affect formation. Although not all effects are precisely known, it appears that the maximum effective cavity depth k is a function of at least the following:

i) the ease with which the stock can be withdrawn from the fluid between the fabrics; this is dependent on the stock type, the web resistance, or amount of incipient paper web deposited on the fabric upstream from the formation blade, and the drainage of the fabric;

ii) the thickness of the fluid stock S remaining between the fabrics as they pass over the upstream cavity wall after liquid has been withdrawn by the foiling action, and iii) the fabric linear speed through the forming section.

In practise it has been found that the cavity depth k should be in the range of from 5% to 35% of the stock thickness S. If k is less than 5% of the stock thickness it appears that little, if any, improvement in formation is obtained. If k more than 35% of the stock thickness then it appears that there is real risk of the cavity not being properly filled, although in certain circumstances values as high as 75% appear to be useable.

For most papermaking machines these limitations imply a cavity depth in the range of from about 0.38 mm to about 2.5 mm, although higher values up to about 10 mm might be appropriate in some circumstances, such as for some grades of linerboard. Since the declining angles for the surfaces 208 and 209 have to be between 0.5° and 8°, determination of the depth d indicates the available range for the machine direction cavity width. The cavity profile is chosen to provide the desired degree of fluid flow into the cavity and then back into the stock. Because the liquid is thus forced to re-enter the stock in the space between the fabrics, a fluid flow occurs within in the stock which serves to reorient the fibers and improve web formation. It is therefore apparent that different phenomena are involved in the formation process in a single fabric open surface forming section to those in the two fabric forming section of this invention.

FIG. 2 shows the invention under dynamic papermaking conditions. In practice, the angles of wrap are difficult to measure under these conditions, and hence these angles must be measured when the machine is at rest. When the machine is at rest and there is no stock between the fabrics, both fabrics 213 and 214 are parallel and hence the angles of wrap for both fabrics are the same.

Figure 3:
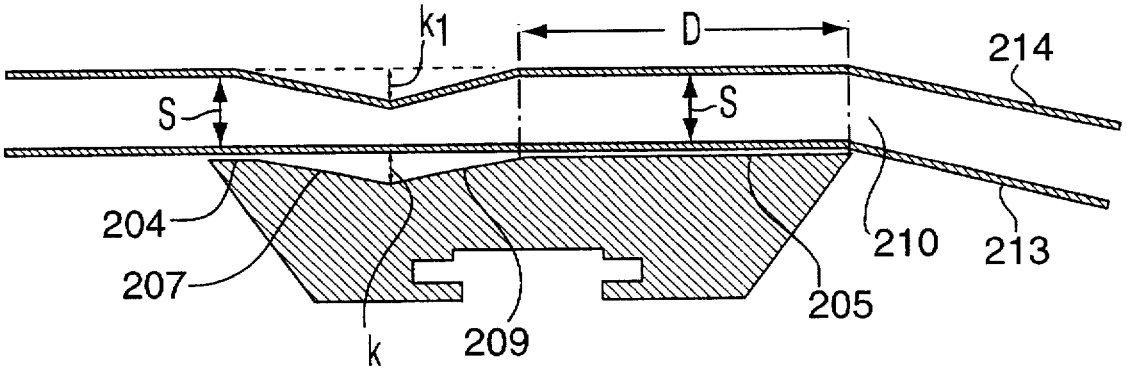
FIG. 3 is a graphical depiction of the variation in thickness of the stock layer above the formation blade in FIG. 2.

In FIG. 3 there is shown schematically the effect of the foiling action in the blade cavity for a blade as shown in FIG. 2 on the stock thickness. In this figure, in comparison to FIG. 2, the stock thickness S has been made thicker for clarity. FIG. 3 also shows the formation blade in use according to this invention, with a more or less tangential approach of the fabrics 213 and 214, with the stock 210 between them, onto the upstream fabric contact surface 204. As liquid is withdrawn from the stock due to the foiling action of the upstream wall 207 the gap between the forming fabrics 213 and 214 decreases by an amount $k_1$ more or less above the point of maximum depth k of the cavity. As the withdrawn liquid flows back into the stock between the two forming fabrics the depth of stock returns to its original value S. The width D of the downstream fabric contact surface 205 has to be sufficient to maintain the hydraulic seal over this surface. If the cavity has been correctly dimensioned, the distances k and $k_1$ are more or less the same.

In FIG. 4 there is shown one embodiment in which a plurality of formation blades 300, 301 and 302, whose cross-sectional profile is essentially as described above, are in the cross machine direction, and are on one side of a curved forming shoe. As illustrated in FIG. 4, the paper machine is in operation and the formation blades are arranged so that the fabrics 213 and 214 which engage them form a segmented curve.

Drainage of liquid from between the two fabrics takes place due to the tensions N and M of the fabrics 213 and 214, and their angles of wrap over the blades 300, 301 and 302, thereby diminishing the thickness of the stock from a relatively high value W, to an intermediate value Y, and to a relatively lower value Z. In this embodiment, the depth k of the cavity on each successive blade is determined for each blade separately at least to accommodate the diminishing stock thickness.

It is neither necessary nor desirable that all of the blades on a curved forming shoe be formation blades. It may be advantageous to intersperse formation blades with deflector blades or other types of fabric support blades such as are well known in the art. The actual positioning of the formation and other blades in the forming section will vary depending on the type of paper being manufactured, the operating conditions of the machine, and other factors. Beneficial effects may be obtained with as few as one formation blade.

Figure 5:
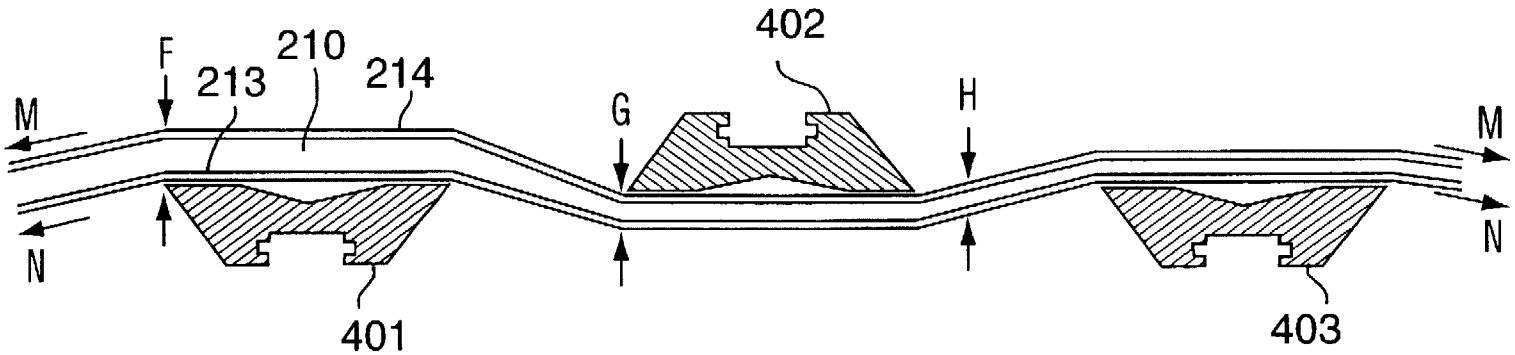
FIG. 5 is a side elevation of a portion of the forming section of a two fabric paper machine in which several formation blades are located in alternating positions on opposing sides of the forming fabrics.

In FIG. 5 there is shown a second embodiment of the present invention in which a plurality of formation blades 401, 402 and 403, substantially as described above, are alternately located on opposing sides of the two fabrics 213 and 214 so as to alternately contact the first fabric 213 and the second fabric 214. The two fabrics follow a zig-zag path between the formation blades. In this embodiment, the stock is alternately subjected to the fluid flow phenomena from the opposing fabric sides. Drainage thus occurs alternately through the first and second fabrics 213 and 214 away from the blades so that the thickness of the stock held between the fabrics decreases from a relatively high value F, through an intermediate value G, to a relatively low value H. As noted above, as few as one formation blade may be sufficient.

Although the positions of the first and second fabrics 213 and 214 are reversed at the second blade 402, in relation to their relative positions at blade 401, the same requirements noted above must still hold true. At the third blade 403, the relative positions of the fabrics revert back to that described at the first blade 401.

In FIGS. 6 through 11 there are shown several possible formation blade profiles. In these Figures the lengths of the contacting surfaces are $L_1$ and $L_4$, the cavity depth is k, the distances $L_2$ and $L_3$ indicate the position of maximum cavity depth relative to the edges of the cavity, and $\Theta_1$ and $\Theta_2$ represent the declining angles of the leading and trailing cavity faces 207 and 209. All of the formation blade features are identified in FIG. 6 with the same numbers as were used in FIG. 2.

Figure 6:
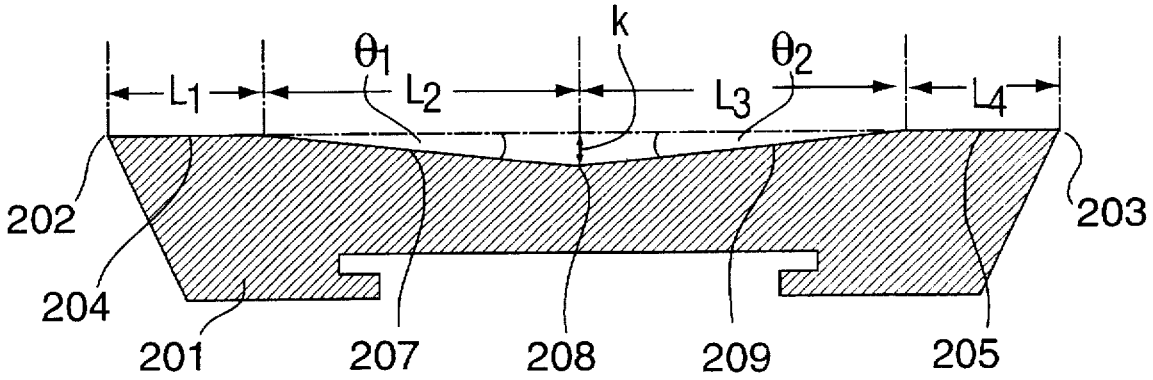
FIGS. 6–11 are cross sectional profiles of other formation blades of use in this invention.

FIG. 6 shows a profile of a symmetrical formation blade design. In this design, $L_1$ and $L_4$ are equal, as also are $L_2$ and $L_3$. The angles $\Theta_1$ and $\Theta_2$ are also the same.

Figure 7:
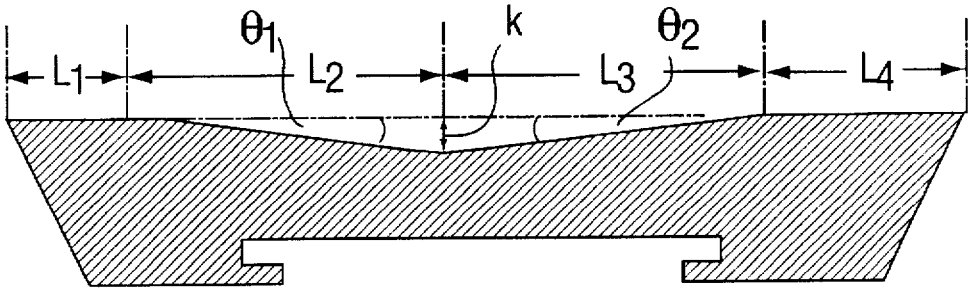

FIG. 7 differs from FIG. 6 in that $L_1$ is shorter than $L_4$, much the same as shown in FIG. 2.

Figure 8:
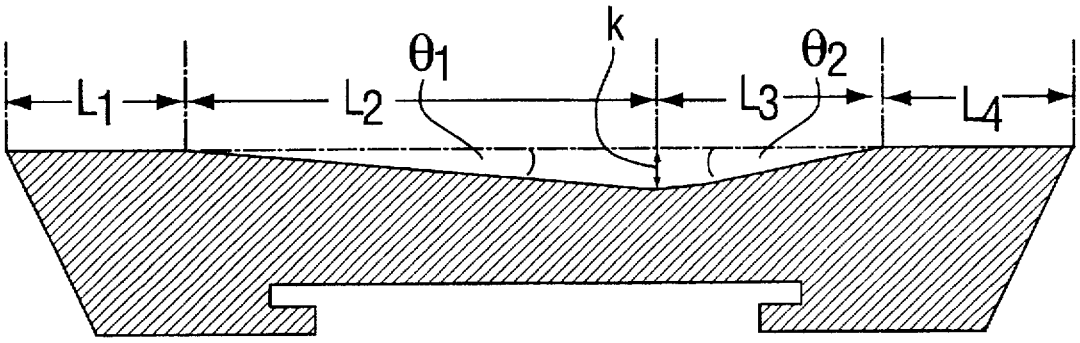

FIG. 8 differs from FIG. 6 in that $L_2$ is longer than $L_3$.

In other words, the blade of FIG. 6 is symmetrical, whilst those in FIGS. 7 and 8 are asymmetrical.

Figure 9:
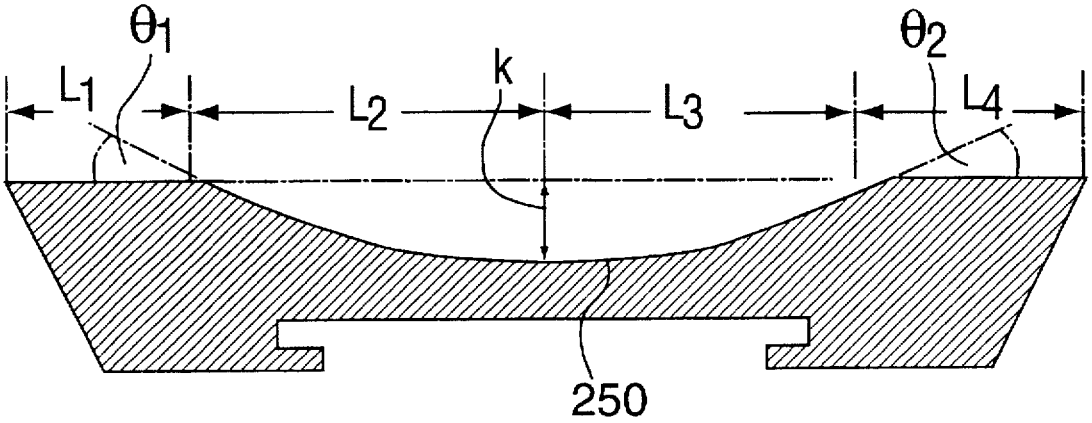

FIG. 9 shows a blade design similar to that shown in FIG. 6 with the exception that the surface 250 of the blade cavity is elliptical. The tangent angle of the upstream wall of the cavity $\theta_1$ is the same as the tangent angle of the downstream wall $\Theta_2$ and the profile of the blade is symmetrical.

Figure 10:
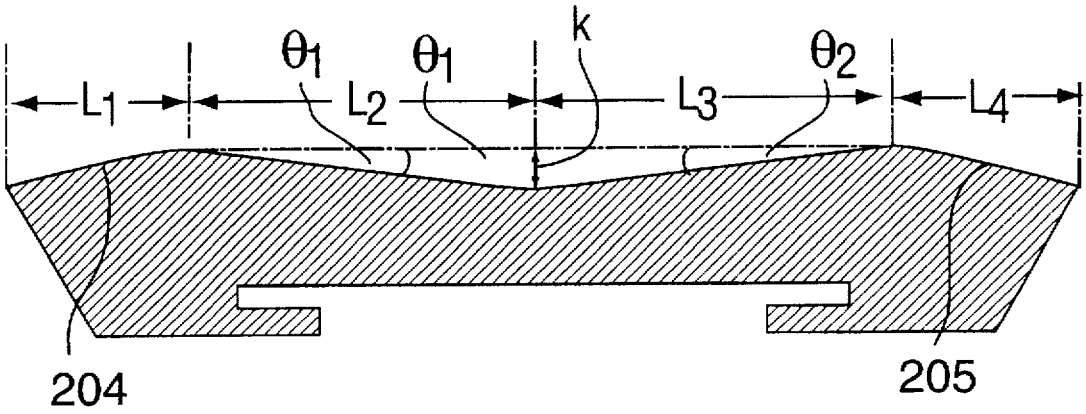

FIG. 10 shows a blade in which both the upstream and downstream fabric contact surfaces are curved so as to approximate the path of the fabrics as they proceed over a curved forming shoe such as that shown in FIG. 4, or through a two-sided shoe similar to that illustrated in FIG. 5. The surfaces 204 and 205 are of equal length, and their radius of curvature would be approximately equal to the radius of curvature of the forming section so that the fabrics approach the surfaces tangentially. The profile of the blade is symmetrical.

Figure 11:
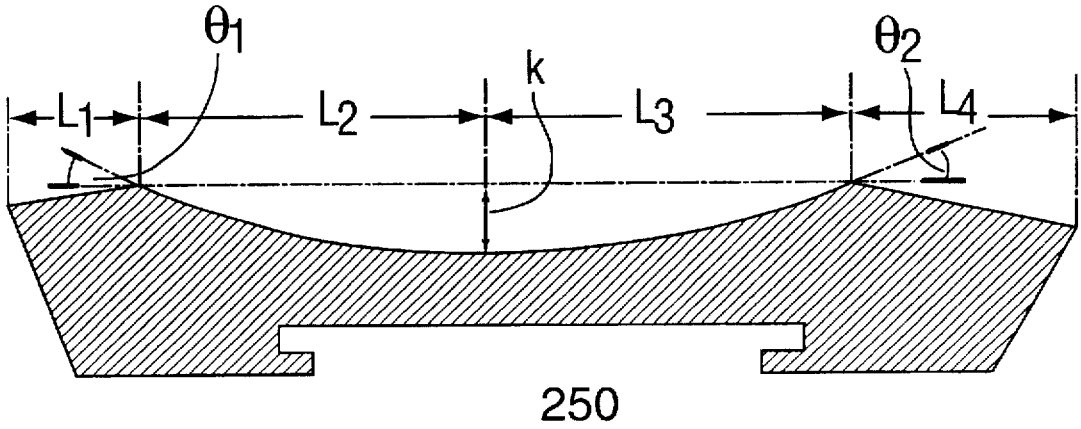

FIG. 11 shows a blade in which both fabric contact surfaces 204 and 205 are curved as in FIG. 10, but the downstream surface 205 is longer than the upstream surface 204 so as to provide a better hydraulic seal between the first fabric (not shown) and the fabric contact surface 205. The surface of the intervening cavity designated generally as 250 is elliptical in shape, similar to that shown in FIG. 9. The tangent angle of the upstream wall of the cavity $\theta_1$ is the same as the tangent angle of the downstream wall $\Theta_2$. The tangent angle is measured relative to the plane of the forming fabric (not shown) over the cavity. The profile of the blade is asymmetrical.

The profile of the formation blade cavities used in this invention may vary, but the angle of divergence of the upstream wall of the cavity from the upstream flat surface must be within the range of from about 0.5° to about 8°. Similarly, the angle of divergence of the downstream wall of the cavity must also be within the range of from about 0.5° to about 8°, which is considerably smaller than the range of 1° to 70° advocated by Johnson for an open surface forming section. Surprisingly, we have found that if the angle of divergence of this downstream wall is greater than 8°, as is taught by Johnson, then the beneficial agitation effects induced in the stock by fluid flow through the cavity are severely diminished.

It may be desirable, for some grades of paper products, to design the blade cavities so that they contain a floor 208 whose machine direction width is greater than zero. If this is done, then the cavity floor may be parallel to the plane of the forming fabric, or upwardly inclined in the downstream direction so as to be at an angle to this plane, provided that the angle does not exceed that of the wall 209, and in any event never exceeds 8°.

Preferably, the formation blades themselves are provided with a ground ceramic surface so as to preserve the shaped profile of the fabric contacting surfaces, as is well known in this art.

It is preferred that the formation blades in the forming section of this invention be mounted on T-shaped rails, as described by White, U.S. Pat. No. 3,337,394. The T-shaped rails are preferably fastened to a frame member so as to permit easy removal and adjustment. It is critical in this mounting that the manufacturing tolerances of the T-slot and the T-bar minimize rocking of the blades. The magnitude of this blade rocking should not exceed ±0.25° and is preferably less. Other mounting means which minimize blade rocking to within the aforementioned limits may be employed to position the formation blades. Since very small angles are important in this invention, accurate maintenance of the blade orientations so as to preserve their alignment with respect to the fabrics is important. Two fabric forming sections use both gravity drainage, and vacuum assisted drainage: the formation blades of this invention can be used in both of these types.

Experimental Test Results

A trial on a gap former running at 1,027 m/min making 36 grams per square meter directory grade paper showed significant improvements in both sheet porosity and formation when 11 of the 13 standard shoe blades were replaced with formation blades. The formation blades were installed on the formation shoe using T-bar mounts whose centre-to-centre spacing was 114 mm. The total shoe wrap angle was 16°, thus providing a total angle of wrap per blade of 1.33°. The 70 mm wide formation blades were provided with a V-shaped shallow cavity having 25.4 mm side walls which were symmetrically angled downwards at 2° from the upstream and downstream contact surfaces to provide a depth k of 0.89 mm. The blades were provided with 9.5 mm upstream and downstream contact surfaces. These formation blades were shown to improve the formation index of the sheet as measured by a Reed N.U.I (Non Uniformity Index) Mark II Formation Tester by 2.0, and reduced sheet porosity by 19% when operating on the shoe at normal vacuum conditions.

In a second trial on another gap former making 48 grams per square meter newsprint at close to 950 m/min., a single formation blade according to the invention replaced one of a series of prior art blades and was found to reduce the sheet porosity by 15%, as well as the two sidedness of the sheet as measured by both lower oil and absorption differences. Measurements of ink stain length also showed a reduced ink absorbency which indicates an improved printing surface. The cavity of this blade was cut so as to provide 46.36 mm long sloping side walls inclined at a 2° angle to the plane of the machine side of the forming fabric passing thereover for a maximum depth of 1.63 mm using 25.4 mm wide upstream and downstream fabric contacting surfaces.

In the first trial 36 grams per square meter directory grade paper is made. To make this grade of paper on an open surface single fabric forming section operating under substantially the same conditions the blade cavity profile would have to be changed to reduce the maximum depth, and therefore also the wall angles, by a factor of about 5. The cavity depth would need to be reduced to 0.18 mm, and the wall angles reduced accordingly. If this is not done, the fluid flow within the cavity will break the required hydraulic seal over the blade downstream fabric contact surface.

Similarly, if the formation blade used in the first trial is used in an open surface single fabric forming section, then the same grade of paper cannot be made. To use this formation blade in an open surface single fabric forming section the stock weight of the paper being made would have to be increased at least to about 180 grams per square meter.

We claim:

1. A forming section, for use in a two-fabric paper making machine having a machine direction and a cross machine direction, including in combination:

(i) a first and a second endless moving forming fabric loop, both loops moving in a joint run at a known speed and under a known tension through the forming section, and between which fabrics a layer of stock of known thickness is conveyed;

(ii) at least one formation blade extending in the cross machine direction in contact with the first fabric such that under the machine direction tension both fabrics with stock therebetween wrap about the at least one blade so that each fabric has a total angle of wrap that is equal to or greater than 0.5° while the first fabric is in hydraulically sealing contact with the formation blade;

(iii) both first and second fabrics wrapping about the downstream edge of the at least one blade with an angle of wrap that is equal to or greater than 0.5°;

(iv) the at least one formation blade having a top face, a bottom, a leading edge and a trailing edge;

(v) the top face of the at least one blade having upstream and downstream fabric contact surfaces in contact with the first fabric with a cavity intervening therebetween; and (vi) the intervening cavity including upstream and downstream walls each diverging from the upstream and downstream fabric contacting surfaces, and having both a Z direction depth measured from the machine side of the first fabric to the lowest point in the cavity, and a machine direction width, wherein a) the upstream cavity wall diverges from the upstream fabric contact surface in a down stream direction at an angle which is from about 0.5° to about 8°, b) the downstream cavity wall diverges from the downstream fabric contact surface in an upstream direction at an angle which is from about 0.5° to about 8°, and c) the cavity depth and width are each sized in proportion to the thickness of the stock layer above the blade upstream surface so as to withdraw fluid from the stock between the forming fabrics by a foiling action, and to return the withdrawn fluid back into the stock as a smooth flow, the amount of fluid flow being effective to improve formation, but ineffective to break the hydraulic seal between the fabric and the formation blade.

2. A forming section according to claim 1 wherein the at least one formation blade includes a cavity in which:

d) the cavity depth is greater than about 5% and less than about 35% of the thickness of the stock layer above the blade upstream fabric contact surface, e) the cavity width ranges from a minimum of about 2.5 times to a maximum of about 25 times the thickness of the stock layer above the blade upstream fabric contact surface, and f) the cavity width and depth are such that when the forming section is operating the cavity is filled with fluid.

3. A forming section according to claim 1 wherein the bottom of the at least one formation blade is provided with a mounting means for locating the blade in the forming section whereby rocking of the blade on the mounting means is restricted to a value that is no more than ±0.25°.

4. A forming section according to claim 1 including more than one formation blade.

5. A forming section according to claim 4 wherein the formation blades are disposed on the same side of the two fabrics.

6. A forming section according to claim 4 wherein the formation blades are disposed on both sides of the two fabrics.

7. A forming section according to claim 4 wherein all of the formation blades are arranged in the cross machine direction along the circumference of a curved forming shoe.

8. A forming section according to claim 6 wherein the formation blades are disposed on opposite sides of the two fabrics so as to cause the fabrics to follow a zig-zag path.

9. A forming section according to claim 1 wherein in the at least one formation blade includes a cavity in which a bottom wall is located between the upstream and downstream walls.

10. A forming section according to claim 1 wherein the at least one formation blade includes a cavity in which a bottom wall which is substantially parallel to the machine side of the first fabric is located between the upstream and downstream walls.

11. A forming section according to claim 1 wherein the at least one formation blade includes a cavity in which a bottom wall which slopes upwardly in the downstream direction at an angle that is less than 8° and less than the angle of the downstream wall is located between the upstream and downstream walls.

12. A forming section according to claim 1 wherein the at least one formation blade includes a cavity in which the angle of the upstream wall is from about 0.5° to about 5°.

13. A forming section according to claim 1 wherein the at least one formation blade includes a cavity in which the angle of the upstream wall is from about 1° to about 4°.

14. A forming section according to claim 1 wherein the at least one formation blade includes a cavity in which the angle of the downstream wall is from about 0.5° to about 5°.

15. A forming section according to claim 1 wherein the at least one formation blade includes a cavity in which the angle of the downstream wall is from about 1° to about 4°.

16. A forming section according to claim 1 wherein the at least one formation blade includes a cavity which has an elliptical profile including both the upstream and downstream walls.

* * * * *